US005373951A

United States Patent [19]

Arnold

[11] Patent Number: 5,373,951

[45] Date of Patent: Dec. 20, 1994

[54] LAUNDRY ROOM SUPPORT RACK

[75] Inventor: William D. Arnold, Florissant, Mo.

[73] Assignee: Lee Rowan Company, St. Louis, Mo.

[21] Appl. No.: 18,804

[22] Filed: Feb. 17, 1993

[51] Int. Cl.[5] ..... A47F 5/00

[52] U.S. Cl. ..... 211/106; 211/90; D6/566

[58] Field of Search ..... 211/106, 90, 18, 123, 211/105.1; 108/152, 149, 29; D6/462, 511, 566

[56] References Cited

U.S. PATENT DOCUMENTS

| | | | |
|---|---|---|---|
| D. 115,255 | 6/1939 | Taylor | D6/566 |
| D. 322,378 | 12/1991 | Colman | D6/566 |
| D. 341,975 | 12/1993 | Winter | D6/566 |
| 3,294,351 | 12/1966 | Rollins | 211/90 X |
| 3,978,799 | 9/1976 | Escalette | D6/566 X |
| 4,511,047 | 4/1985 | Elinsky | 211/106 X |
| 5,125,517 | 6/1992 | Martinell | 211/90 X |
| 5,257,700 | 11/1993 | Wallace | 211/106 X |

*Primary Examiner*—Robert W. Gibson, Jr.
*Attorney, Agent, or Firm*—Rogers, Howell & Haferkamp

[57] ABSTRACT

A laundry room support rack has a wire frame shelf supported by wire frame sides. Each wire frame side has three wire segments. A horizontal segment extends in the front to back direction. A vertical segment extends up from the back end of the horizontal segment. And a diagonal segment extends between an upper end of the vertical segment and a forward end of the horizontal segment. A cross member extends between the opposite upper ends, and has apertured portions for receiving wall fasteners. A front U-shaped segment has arms securely engaging the frame sides at positions near the front ends. The U-shaped segment has a horizontal base segment that permits the hanging of garment hangers thereon. The frame sides gain strength from the diagonal segments for supporting loads on the shelf and the horizontal base segment.

24 Claims, 1 Drawing Sheet

LAUNDRY ROOM SUPPORT RACK

BACKGROUND AND SUMMARY OF THE INVENTION

The present invention relates to a wall-mounted support rack, and more particularly to a rack having a wire frame shelf and a garment hanger rod in combination for supporting articles usually associated with residential laundry rooms.

Wire frame shelves and mounting hardware to match can be made available in disassembled form in retail stores at low cost. Retail consumers thus are responsible for the mounting of these shelves for themselves. Yet the known shelves are relatively difficult to mount. Many retail consumers are uncomfortable with and so would prefer to avoid measurement, lay-out and hand tool operations. Nevertheless, the known shelves usually come available as kits, with disassembled parts like angled brackets, side brackets and/or retaining clips. See, for example, U.S. Pat. No. 4,361,009.

The known wire frame shelves are more generally deficient at meeting the needs of specific storage situations at minimum cost. The present invention, for example, involves articles usually associated with residential laundry rooms. Such articles range from containers of powdered, liquid, and aerosol laundry products to garments hung on garment hangers. The known wire frame shelves are likely to be excessively sized or reinforced for the duty that involves laundry room articles, thereby resulting in needless additional costs.

Accordingly, it would be useful to provide a shelf system that is specially adapted for supporting laundry room articles, that is easy to mount, that is inexpensive, and that is durable and strong.

In accordance with the present invention, a laundry room support rack has a wire frame shelf supported by wire frame sides. Each frame side includes three wire segments. A horizontal segment extends between a rear connection and a forward connection. A vertical segment extends up from the rear connection to an upper connection. And a diagonal segment extends between the upper connection and the forward connection. Preferably, a cross member extends between the opposite upper connections, and supports two apertured fixtures, each of which receives a wall fastener like a screw. The diagonal segment is positioned relative to the shelf to provide side support for taller articles placed on the shelf. The laundry room support rack further includes a U-shaped segment with arms securely engaging the frame sides at positions near the front connections. The U-shaped segment has a horizontal base segment that permits the hanging of garment hangers thereon. The frame sides gain strength from the diagonal segments for supporting loads on the shelf and horizontal base segment.

The prior art shelves teach away from fixed racks like the present invention by suggesting that compact storage is achieved by the provision of collapsible assemblies of generally planar parts for packing in relatively compact cartons for economizing on shipment and storage costs. The laundry room support racks of this invention are nestable and can be made unitary and easier for homeowners to handle and install. The diagonal segments of the frame sides lie in vertical planes laterally out from the horizontal and vertical segments, thereby permitting one rack to nest with another like rack. Nestability permits the packing of relatively more racks in a single carton, thereby gaining more cost savings in the per-unit shipment and storage cost. Nestability also permits relatively greater numbers of racks to be displayed on retail store shelves.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
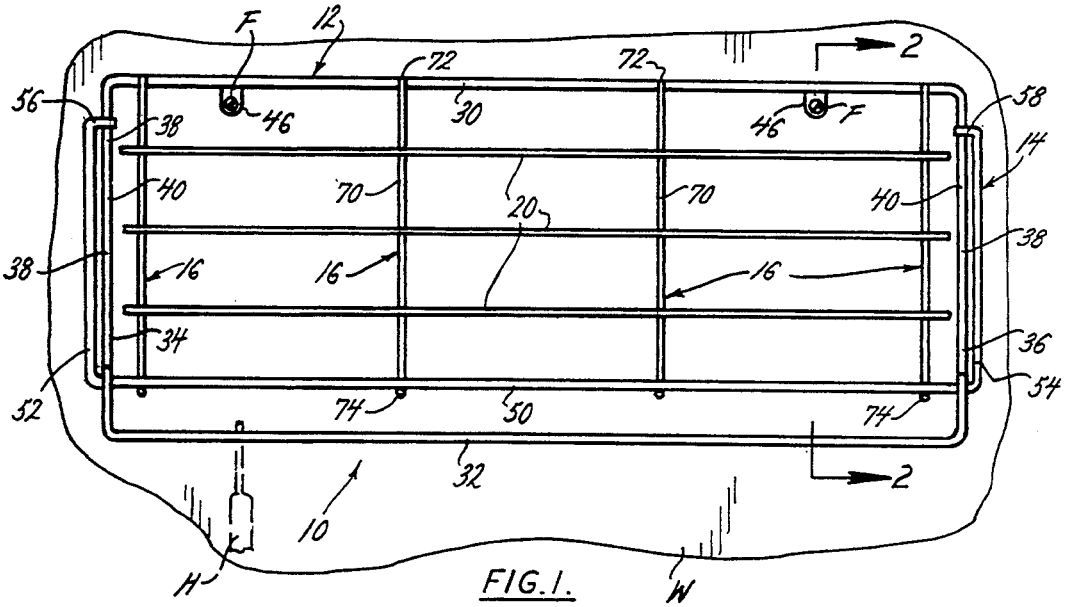
FIG. 1 is a front elevation view of the laundry room support rack of the present invention, with a garment hanger, shown in broken lines for illustrative purposes and partly broken away, hanging from a front span of the present rack.
Figure 2:
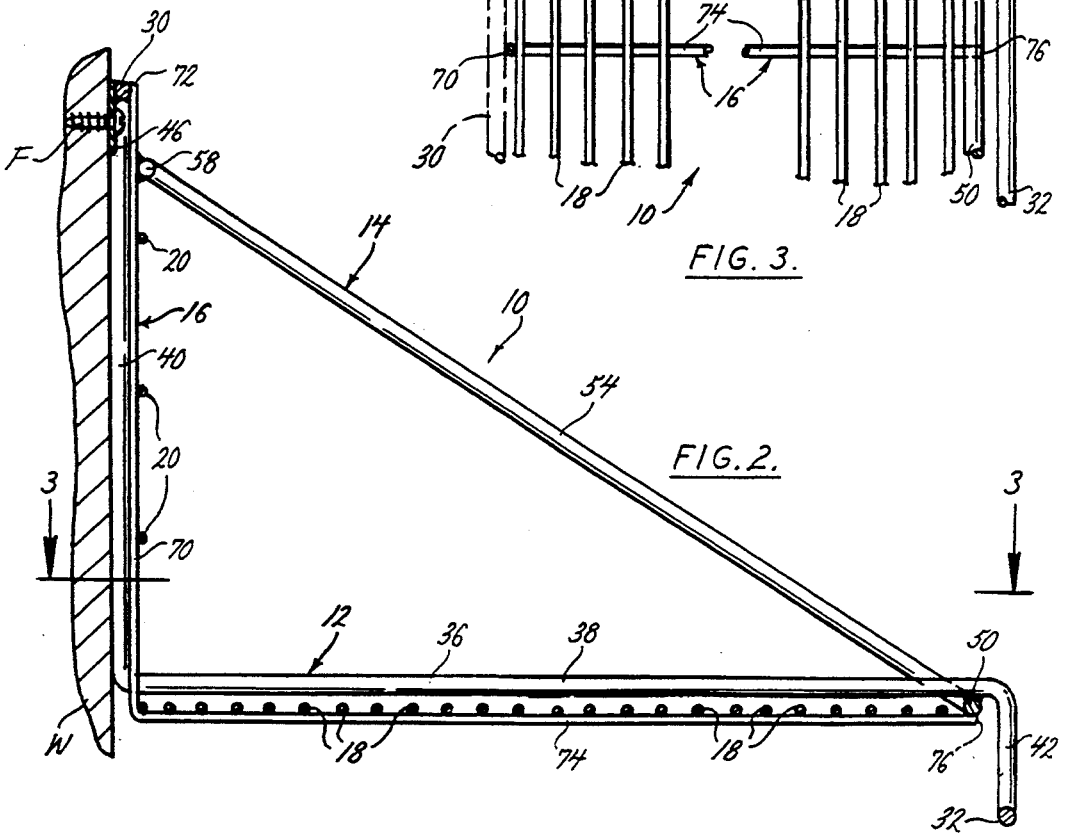
FIG. 2 is an enlarged section view taken along the line 2—2 of FIG. 1.

The FIGS. 1 and 2 show the laundry room support rack 10 of the present invention mounted to a wall W. The laundry room support rack 10 is a frame rack of wire elements held together by welded joints. The wire elements include a continuous element 12, an inclined-U shaped element 14, parallel L-shaped elements 16, parallel shelf wires 18, and parallel partition wires 20.

The continuous element 12, acting as a main frame for the rack 10, consists of a horizontal upper-rear segment 30, a parallel lower-front segment 32, and opposite Z-shaped sides 34 and 36 on the left and right (as viewed in FIG. 1). The "Z" shape of the sides 34 and 36 is defined by three segments. With reference to FIG. 2, a central segment 38 extends horizontally in the front to rear direction between a rear bend and a forward bend. A rear-outer segment 40 extends up from the rear bend of the central segment 38 to Join the upper-rear segment 30. A forward-outer segment 42 depends from the forward bend of the central segment 38 to join the lower-front segment 32. For mounting the rack 10, the upper-rear segment 30 supports mounting fixtures 46, which have apertures for receiving fasteners F. The fixtures 46 are pieces of metal plate welded in place in spaced relationships to correspond to the usual spacing between wall studs in residential dwellings.

The inclined-U shaped element 14 has a horizontal cross segment 50 extending between opposite bends, and has inclined arms 52 and 54 extending from the opposite bends to inwardly bent ends 56 and 58. The lateral span of the cross segment 50 is greater than the lateral separation between the Z-shaped sides 34 and 36. The greater relative span of the cross segment 50 permits it to extend between and underlie the opposite central segments 38 of the Z-shaped sides 34 and 36. The cross segment 50 and the central segments 38 are welded together at positions on the central segments 38 near the front bends where they join the outer-front segment 32.

The inclined arms 52 and 54 extend diagonally up and back from the cross segment 50 in vertical planes laterally out from the Z-shaped sides 34 and 36. The bent ends 56 and 58 are welded to the rear-outer segments 40 at positions on the rear-outer segments 40 near the top bends where they join the upper-rear segment 30.

The parallel L-shaped elements 16 have vertical stems 70 extending between central bends and top ends 72, and have horizontal feet 74 extending forwardly from the central bends to front ends 76. The L-shaped elements 16 have their top ends 72 welded to the upper-rear segment 30, and have their front ends 76 welded to the cross segment 50 of the inclined-U shaped element 14.

Figure 3:
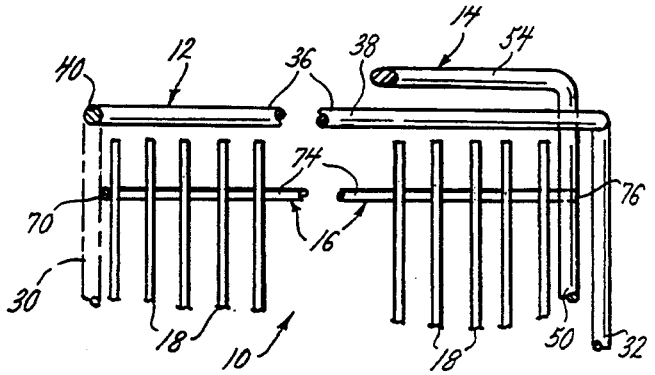
FIG. 3 is a section view, partly broken away, taken along the line 3—3 of FIG. 2.

The forwardly extending feet 74 of the L-shaped element 16 provide support for the laterally extending shelf wires 18. The shelf wires 18 are welded in place in the parallel arrangement shown by FIGS. 2 and 3. The laterally extending partition wires 20 are welded to the vertical stems 70 of the L-shaped elements 16 as shown by FIG. 1.

The parallel shelf wires 18 have upper surfaces defining a horizontally planar shelf surface for the placement of articles thereon. The inclined arms 52 and 54 provide side support for articles placed on the shelf surface, so that taller articles are blocked from falling over the sides. The cross segment 50 of the inclined-U shaped element 14 protrudes higher than the shelf surface, thereby providing a front retaining rail. Similarly, the left and right central segments 38 protrude higher than the shelf and thus provide the shelf with left and right retaining rails. The partition wires 20 retain the articles placed on the shelf surface from abutting the wall W.

The lower-front segment 32 permits the hanging of garment hangers H thereon. The continuous element 12 gains strength from the inclined arms 52 and 54 for supporting loads on the shelf and the lower-front segment 32. For example, the continuous element 12 and the inclined-U element 14 can be made from wire merely ¼ inches in diameter, yet will satisfactorily support a usual load of garments and laundry products for a 2 foot long garment hanger segment and a shelf surface of 2 feet (left to right) by 1 foot (front to rear).

The forward-outer segments 42 of the continuous element 12 act as side retainers for garment hangers H but, between the forward-outer segments 42, garment hangers H can be pushed or moved along the full lateral span of the lower-front segment 32 without other obstruction.

Because the diagonally extending arms 52 and 54 of the inclined-U shaped element 14 lie in vertical planes laterally out from the Z-shaped sides 34 and 36, the wall rack 10 can nest with another like wall rack in closely spaced relationships.

While the present invention has been described by reference to a specific embodiment, it should be understood that modifications and variations of the invention may be constructed without departing from the scope of the invention defined in the following claims.

What is claimed is:

1. A wall rack comprising:

a main frame comprising a continuous element having opposite Z-shaped side segments;

each Z-shaped side segment having a generally horizontal central portion extending between front and rear bends, a rear outer portion extending up from the rear bend to a top bend, and a front outer portion extending down from the front bend to a bottom bend;

the continuous element further having an upper-rear segment extending between the opposite top bends and a lower-front segment extending horizontally between the opposite bottom bends;

a pair of inclined segments having lower sections securely engaging the main frame at positions near the front bends, and extending diagonally up to upper sections securely engaging the main frame at positions near the top bends;

a shelf supported by the main frame and disposed in fixed relationships with the Z-shaped side segments; and mounting means associated with the upper-rear segment for mounting on a wall;

wherein the lower-front segment permits the hanging of garment hangers thereon while the main frame gains strength from the inclined segments for supporting loads on the shelf and the lower-front segment.

2. The wall rack of claim 1 wherein:

the continuous element is a continuous wire element.

3. The wall rack of claim 1 wherein:

the continuous wire element generally has a diameter of about ¼ inch, and the lower-front segment generally has a span of about 2 feet.

4. The wall rack of claim 1 wherein:

the inclined segments are spaced further apart from one another than are the Z-shaped side segments, thereby permitting said wall rack to nest with another like shelf.

5. The wall rack of claim 1, for supporting garment hangers and containers of powdered, liquid, and aerosol laundry products and the like, wherein:

the inclined segments provide side retainers for containers of laundry products placed on the shelf.

6. The wall rack of claim 1 wherein:

the inclined members are a left and a right arm of an inclined-U shaped element comprising a horizontal cross segment extending between the left and right arms, the horizontal cross segment providing the shelf with a front retaining lip.

7. The wall rack of claim 1 wherein:

the mounting means includes members with apertures for receiving fasteners.

8. The wall rack of claim 1 wherein:

the shelf includes a fixed arrangement of parallel wires defining a shelf surface.

9. The wall rack of claim 8 wherein:

the parallel wires extend laterally, and a plurality of L-shaped wires have vertical stems and horizontal feet extending forwardly; the horizontal feet supporting the parallel wires; the vertical stems extending to upper sections in secure engagement with the upper-rear segment and supporting other spaced wires which define a rear partition for retaining articles placed on the shelf member from abutting the wall.

10. The wall rack of claim 1 wherein:

the horizontal central portions of the Z-shaped side segments are disposed higher than the shelf, thereby providing the shelf with left and right retaining rails.

11. A wall rack comprising:

left and right support members, each support member having a horizontal support section and a vertical support section;

an inclined-U shaped member having a transverse rod with left and right bends at opposite ends of the transverse rod, and left and right arms extending diagonally and upwardly from the left and right bends, respectively, the left and right arms having upper ends attached to the vertical support sections of the left and right support members, respectively, the transverse rod being attached to the horizontal support sections of the left and right support members;

a shelf attached to the transverse rod and supported by the inclined-U shaped member; and means for attaching the rack to a wall.

12. The wall rack of claim 11, further comprising:

a lower U-shaped member having left and right stems and a hanger rod having a length extending between the left and right stems, the left and right stems having upper ends attached to the horizontal support sections of the left and right support members, respectively.

13. The wall rack of claim 12, wherein:

the hanger rod is configured with no obstructions between the left and right stems and thereby enables the free sliding of clothes hangers along the length of the hanger rod.

14. The wall rack of claim 11, further comprising:

an upper support member extending between and attached to the vertical support sections of the left and right support members, the shelf having a vertical support surface and a horizontal support surface, the shelf vertical support surface being attached to the upper support member.

15. The wall rack of claim 14, wherein:

the horizontal support sections of the left and right support members and the transverse rod are positioned above the shelf horizontal support surface and thereby prevent items from sliding off the shelf.

16. The wall rack of claim 14, wherein:

the shelf support surfaces comprise a plurality of parallel wires fixed in relative positions.

17. The wall rack of claim 11, wherein:

the shelf includes a plurality of parallel wires fixed in relative positions.

18. A wall rack comprising:

a main frame comprising a continuous rod having opposite side segments, a rear upper segment, and a forward lower segment, each of the side segments having a horizontal portion and a vertical portion;

an inclined-U shaped member having left and right stems and a transverse stem, the left and right stems having upper ends connected to the vertical portions of the opposite side segments, the transverse stem being connected to the horizontal portions of the opposite side segments; and a shelf attached to the transverse stem and supported by the inclined-U shaped member.

19. The wall rack of claim 18, wherein:

the shelf comprises a horizontal shelf surface having a plurality of parallel wires in fixed relative positions.

20. The wall rack of claim 19, wherein:

the horizontal portions of the opposite side segments and the transverse stem are positioned above the horizontal shelf surface and thereby prevent items from sliding off the shelf.

21. The wall rack of claim 18, wherein:

the shelf includes a horizontal support surface and a vertical support surface, the vertical support surface being attached to the rear upper segment.

22. The wall rack of claim 21, wherein:

the shelf further includes a plurality of L-shaped wires, each L-shaped wire having a vertical wire and a horizontal wire, a plurality of parallel wires traversing and being attached to the vertical wires defining the vertical support surface, and a plurality of parallel wires traversing and being attached to the horizontal wires defining the horizontal support surface.

23. The wall rack of claim 18, wherein:

the left and right stems of the inclined-U shaped member are spaced further apart than the opposite side segments and thereby enable the wall rack to nest with another like rack.

24. The wall rack of claim 18, further comprising:

means for mounting the rack to a wall.

* * * * *